US005201356A

United States Patent [19]

Chenel

[11] Patent Number: 5,201,356

[45] Date of Patent: Apr. 13, 1993

[54] PARTITION, IN PARTICULAR FOR EXHIBITION STANDS, AS WELL AS STANDS PRODUCED USING THIS PARTITION

[76] Inventor: Guy G. Chenel, 1, rue Marcel Loyau, Boulogne, France

[21] Appl. No.: 786,062

[22] Filed: Oct. 31, 1991

[30] Foreign Application Priority Data

Nov. 9, 1990 [FR] France ..... 90 13911

[51] Int. Cl.[5] ..... A47G 5/00

[52] U.S. Cl. ..... 160/351; 160/135; 160/349.1

[58] Field of Search ..... 52/239, 240; 160/351, 160/135, 86, 349.1

[56] References Cited

U.S. PATENT DOCUMENTS

| | | | |
|---|---|---|---|
| 1,245,237 | 11/1917 | Johnston | 160/135 X |
| 1,882,150 | 10/1932 | Kent | 160/135 X |
| 2,670,504 | 3/1954 | Peterson | 52/239 X |
| 4,373,570 | 2/1983 | Nussdorf | 160/352 |

FOREIGN PATENT DOCUMENTS

| | | | |
|---|---|---|---|
| 8811180.6 | 2/1989 | Fed. Rep. of Germany . | |
| 955553 | 6/1949 | France | 160/135 |
| 2595737 | 3/1986 | France . | |
| 2624062 | 12/1987 | France . | |
| 2637631 | 10/1988 | France . | |
| 503390 | 12/1954 | Italy | 160/86 |
| 503350 | 4/1939 | United Kingdom | 160/135 |

*Primary Examiner*—Blair M. Johnson

[57] ABSTRACT

A partition for exhibition stands having at least one upper horizontal cross member and at least one lower horizontal cross member connected to one another by vertical uprights. A flexible material ring is disposed about the upper and lower cross members in order to bear via an upper loop on the upper member and hang via a lower loop under the lower cross member with a ballast being disposed inside the ring at the level of the lower loop so as to be located below the level of the lower cross member.

12 Claims, 2 Drawing Sheets

PARTITION, IN PARTICULAR FOR EXHIBITION STANDS, AS WELL AS STANDS PRODUCED USING THIS PARTITION

This partition is characterized in that it comprises a supporting structure having at least one upper horizontal cross member and at least one lower horizontal cross member connected to one another by two vertical uprights such that the lower cross member is at a distance from the lower end of the uprights and such that it forms an empty space with the ground, and in that a ring of flexible material is disposed about the upper and lower cross members so as to bear via an upper loop on the upper cross member and hang via a lower loop under the lower cross member, ballast being disposed inside the ring at the level of the lower loop so as to be located in the empty space formed under the lower cross member.

According to a further feature of the invention, the supporting structure comprises at least one intermediate upright or cross member connecting the uprights and/or cross members of the rigid supporting structure.

According to a further feature of the invention, the ballast comprises a profiled section disposed inside the lower loop of the ring.

In accordance with a further feature of the invention, the ring has at least one lateral indentation on each of its two edges, these two indentations being opposite one another.

According to a further feature of the invention, the ring is an open ring and is provided with detachable means for securing its two edges.

The invention is illustrated by way of non-limiting example in the attached drawings in which.

The aim of the present invention is therefore to provide a partition which is easy to construct, assemble and dismantle, is lightweight and occupies a small amount of space for handling and storage, and has a pleasing aesthetic appearance.

Furthermore, this partition which may be easily produced in a sufficiently stable manner, is economic, visually isolates stands from one another and may easily satisfy safety provisions as regards fire-resistance.

Moreover, one of the advantages of the partition according to the invention lines in the fact that it may be subject to impact or pressure without deforming definitively and without being marked, and the costs of maintaining or restoring the partition if it becomes dirty may also be low.

This framework thus combines the advantages of a rigid supporting structure and a surface having a flexible facing which does not require any tooling or particular means or qualified labour to be assembled on the rigid structure.

This combination uses a simple and economic technique which are important criteria if it is wished to assembly or dismantle stand partitions rapidly, these stands being of low cost and easy to maintain.

Figure 1:
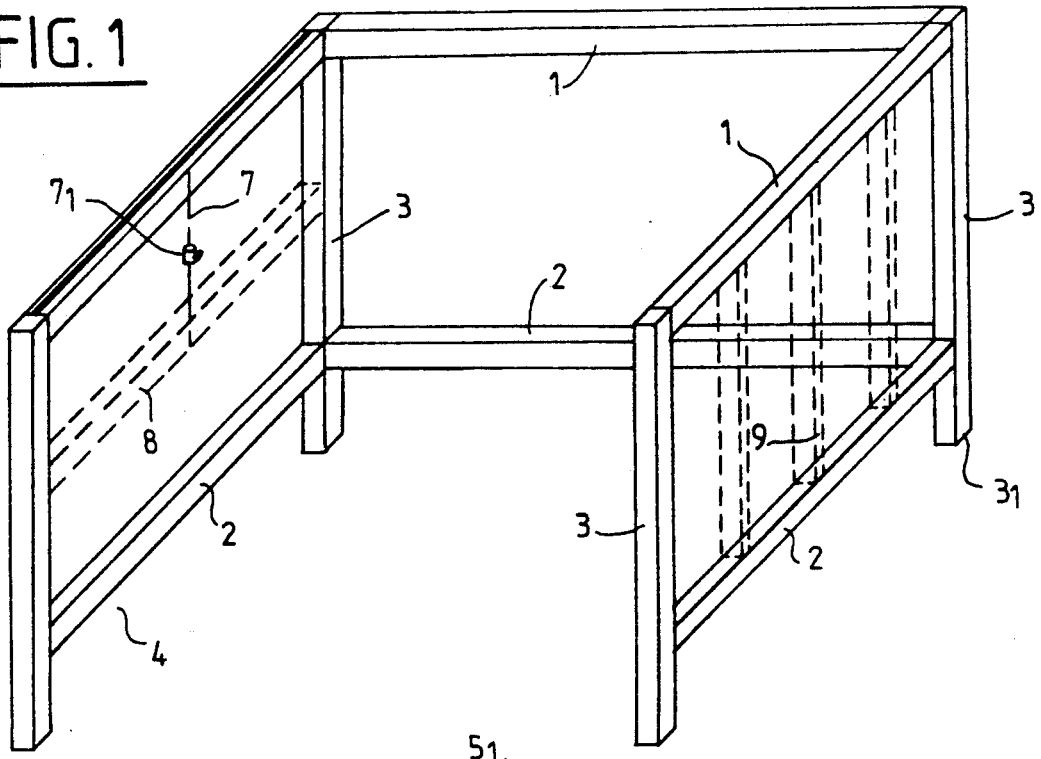
FIG. 1 is a perspective view of the framework of the partition according to the invention.
Figure 3:
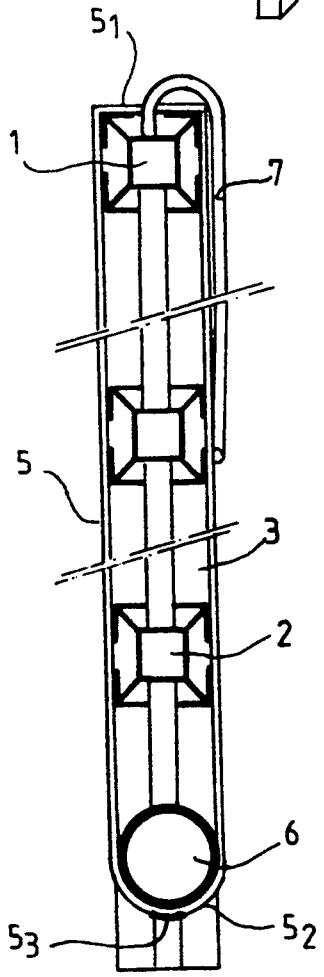
FIG. 3 is a section along A—A in FIG. 2.
Figure 2:
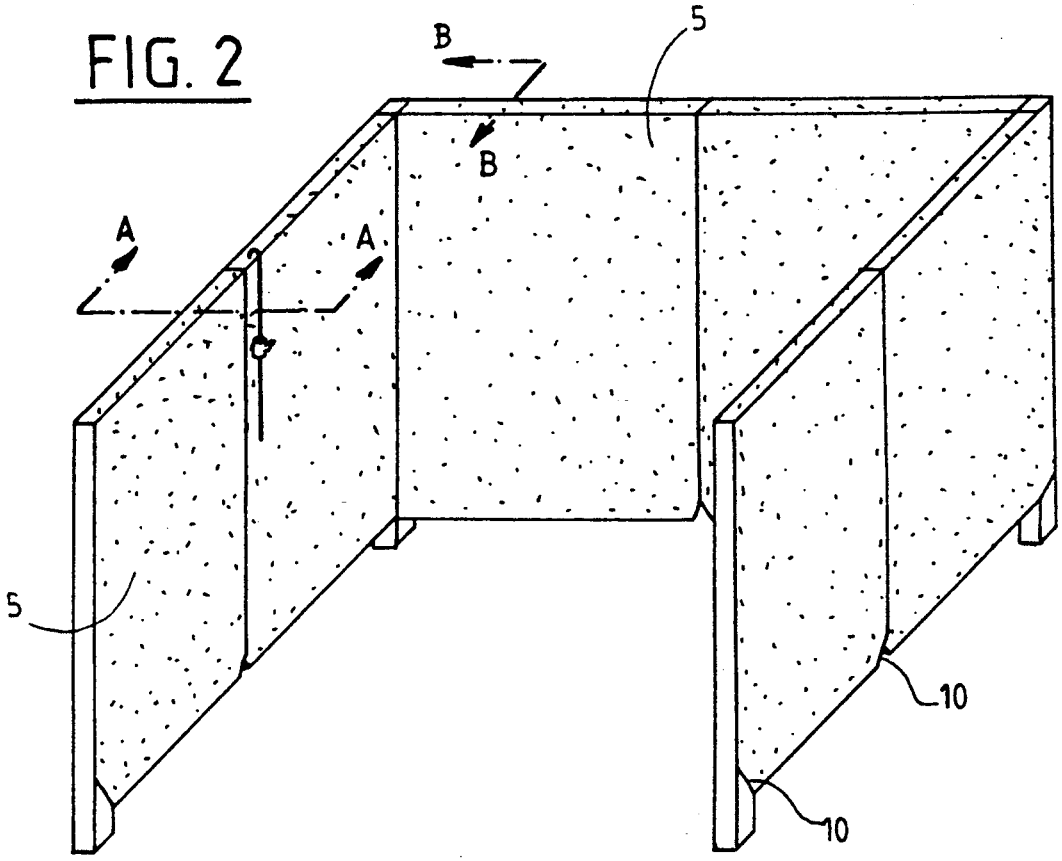
FIG. 2 is a view corresponding to FIG. 1, the partition being provided with its outer covering.
Figure 4:
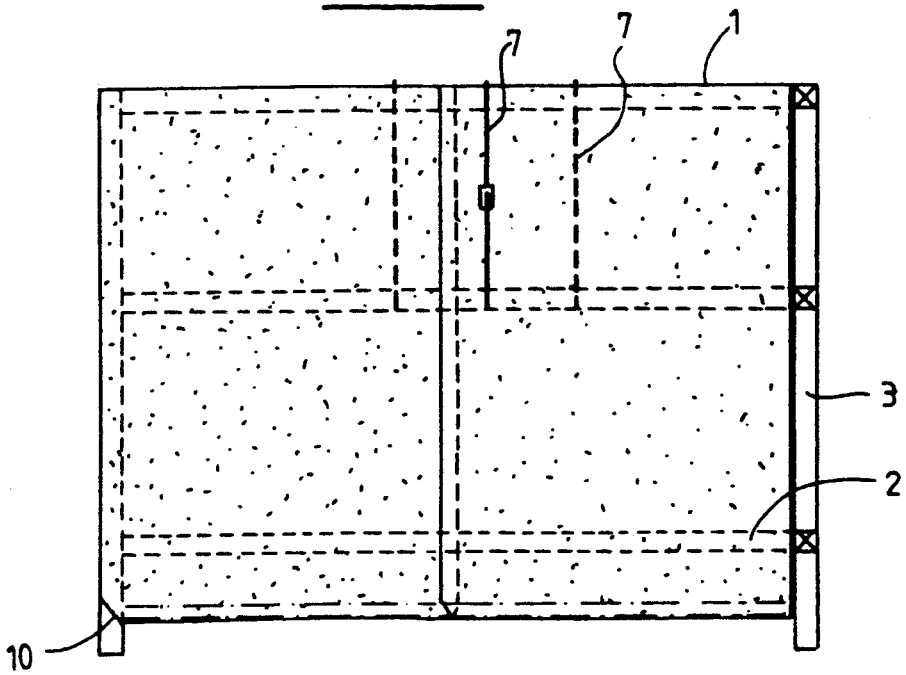
FIG. 4 is a section along B—B in FIG. 2.

In accordance with the invention, it is proposed to provide a rigid structure (see FIG. 1) which consists of upper horizontal cross members 1 and lower, preferably horizontal cross members 2 which are connected to one another by vertical uprights 3 defining rigid frames.

These uprights 3 are intended to be positioned or secured on the ground by any means and each lower cross member 2 is located at a given distance from the lower end $3_1$ of the vertical uprights, so as to form an empty space 4 under this lower cross member 2 and between the base of its vertical uprights 3.

These uprights and cross members may be produced from wood or even better, using profiled sections of aluminium assembled in a detachable manner by suitable joining members.

In order to produce the partitions from this rigid structure, it is proposed to use rings of a flexible material of paper or tissue, which are disposed about the upper and lower cross members 1, 2 so as to form an upper loop $5_1$ which bears against an upper cross member 1 and a lower loop $5_2$ which hangs under a lower cross member 3.

In order to facilitate the assembly of this ring on the structure, the ring is preferably open transversely at $5_3$, the two edges thus formed being connected in a detachable manner by any means in order to enable the closed ring to be reconstituted after the upper and lower cross members have been positioned.

In order to ensure that the partition has a suitable appearance this flexible ring is tensioned by means of ballast 6 which is disposed inside the lower loop $5_2$ under the lower cross member 3, i.e. within the thickness of the partition itself inside the space 4.

This ballast may consist of a cylindrical wooden or metal profiled section for example and preferably the detachable joining means $5_3$ of the two edges of the open ring are located at the level of this ballast 6 in order to be concealed under the partition.

This ballast may also consist of a profiled section having two edges which clamp the two ends of the sheet of flexible material so as to form the ring.

Optionally, one of the edges of the open ring may be secured to this ballast 6 which will then serve as a winding mechanism for the flexible material of the partition for its storage when the partition has been dismantled.

This partition thus combines the advantages of a rigid and recessed or open structure and the advantages of a rapidly replaceable flexible covering material, in order to produce a partition which may withstand localised pressure without deforming or being marked definitively.

In effect when lateral pressure is exerted on one of the faces of the partition, the flexible material of the ring is pushed in against the force exerted by the ballast and as soon as this pressure ceases the ballast 6 returns the partition to its initial plane form.

The partition according to the invention thus comprises a rigid structure and a flexible covering material maintained at constant tension which requires no particular means for fastening it to the rigid supporting structure.

In order to prevent this partition being able to be pushed in too greatly, it is proposed to provide inside the frames defined by the cross members and uprights 1, 2, 3, intermediate uprights and cross members, 9 and 8 respectively, of which the essential aim is not to contribute to the rigidity of the supporting structure but to form in the horizontal direction zones of local support for the flexible material forming the ring 5.

Thus the intermediate cross members 8 are disposed at a level corresponding to that of a chairback or even at the level of the lower end of a rod assembly 7 terminating at its upper end in a hook engaging on the top of a cross member 1. This rod assembly is intended to receive a means $7_1$ for securing an exhibition panel or any other object.

This rod assembly 7 is thus correctly positioned firstly by the fastening of its upper end on a cross member 1 and secondly by bearing laterally on an intermediate cross member 8.

The position of this intermediate upright and cross member 9, 8 can be adjusted by sliding over the uprights and cross members 1, 2, 3 if these elements are produced from aluminium profiled sections provided with longitudinal slots.

The rings are preferably of a standard width and, in order to enable the rings of adjacent partitions to be positioned by superimposing their edges slightly, the profiled sections forming ballast 6 are of a length which is less than the width of the rings. These rings further comprise two indentations 10 which are disposed facing each other on the two opposite edges of the ring in order to cover at least partially the uprights 3 or in order to enable adjacent rings to overlap.

I claim:

1. Partition in particular for exhibition stands, characterized in that it comprises a supporting structure having at least one upper horizontal cross member (1) and at least one lower horizontal cross member (2) connected to one another by two vertical uprights (3) such that the lower cross member is at a distance from the lower end $(3_1)$ of the uprights and such that it forms an empty space (4) with the ground; and in that a flexible material ring (5) having two edges is disposed about the upper and lower cross members (1, 2) in order to bear via an upper loop $(5_1)$ on the upper cross member (1) and hang via a lower loop $(5_2)$ under the lower cross member (2), ballast (6) being disposed inside the ring (5) at the level of the lower loop $(5_2)$ so as to be located in the empty space (4) formed under the lower cross member (2).

2. Partition according to claim 1, characterized in that the supporting structure comprises at least one intermediate upright (9) connecting the cross members (1, 2) of the rigid supporting structure.

3. Partition according to claim 2, characterized in that the position of the intermediate uprights is adjustable along the cross members (1, 2) of the rigid structure.

4. Partition according to claim 1, characterized in that the ballast consists of a profiled section disposed inside the lower loop of the ring.

5. Partition according to claim 1, characterized in that the ring (5) has at least one lateral indentation (10) on each of its two edges, these two indentations being located opposite one another.

6. Partition according to claim 1, characterized in that the ring (5) is an open ring and is provided with detachable means for fastening its two edges.

7. Partition according to claim 6, characterized in that the ballast (6) is located at the level of the join $(5_3)$ of the two edges of the open ring.

8. Partition according to claim 1, characterized in that the ring is made of paper.

9. Partition according to claim 1, characterized in that the supporting structure comprises at least one intermediate cross member (8) connecting the upright (3) of the rigid support structure.

10. Partition according to claim 9, characterized in that the position of the intermediate cross members is adjustable along the uprights (3) of the rigid structure.

11. Partition according to claim 1, characterized in that the support structure comprises at least one intermediate upright (9) connecting the cross members (1, 2) and at least one intermediate cross member (9) connecting the uprights (3) of the rigid supporting structure.

12. Partition according to claim 11, characterized in that the position of the intermediate uprights is adjustable along the cross members (1, 2) and the position of the cross member is adjustable along the uprights (3) of the rigid structure.

* * * * *